US010401124B1

(12) United States Patent
Bartoszewicz

(10) Patent No.: US 10,401,124 B1
(45) Date of Patent: Sep. 3, 2019

(54) SYSTEM, METHOD, AND APPARATUS FOR LEVELING A FIREARM ACCESSORY

(71) Applicant: SCALARWORKS, LLC, Easton, PA (US)

(72) Inventor: Philippe Bartoszewicz, South Orange, NJ (US)

(73) Assignee: SCALARWORKS, LLC, Easton, PA (US)

( * ) Notice: Subject to any disclaimer, the term of this patent is extended or adjusted under 35 U.S.C. 154(b) by 0 days.

(21) Appl. No.: 16/027,949

(22) Filed: Jul. 5, 2018

(51) Int. Cl.
*F41G 11/00* (2006.01)
*F41G 1/54* (2006.01)

(52) U.S. Cl.
CPC ..... *F41G 11/003* (2013.01); *F41G 1/545* (2013.01)

(58) Field of Classification Search
CPC ..... F41G 11/003; F41G 1/545
See application file for complete search history.

(56) References Cited

U.S. PATENT DOCUMENTS 2,663,083 A * 12/1953 Harms ..... F41G 11/001 42/126
3,177,587 A * 4/1965 Hart ..... F41G 11/002 42/126
5,490,654 A * 2/1996 Herriman ..... F41G 11/001 248/309.1
10,288,378 B2 * 5/2019 Minor ..... F41G 11/003
2017/0102213 A1 * 4/2017 Bartoszewicz ..... F41G 11/003
2018/0058813 A1 * 3/2018 Minor ..... F41G 11/003
2019/0017781 A1 * 1/2019 Noonan ..... F41G 1/26

OTHER PUBLICATIONS

"Ideal Scope Mounting System", Spuhr AB (Year: 2017).*
"Uni-Block Scope Mount", Really Right Stuff, LLC (Year: 2017).*

* cited by examiner

*Primary Examiner* — Joshua T Semick
(74) *Attorney, Agent, or Firm* — Eversheds Sutherland (US) LLP

(57) ABSTRACT

A firearm accessory mount can be used to mount an aiming device to a firearm. The accessory mount can include a base plate having a top and bottom side. A first scope mounting ring and a second scope mounting ring can be coupled to the base plate and separated a distance from each other. Each of the scope mounting rings can be coupled to different portions of an aiming device, such as a rifle scope. A threaded aperture can extend through the base plate and can be positioned between the scope mounting rings. A leveling screw can be inserted in the aperture and have a substantially flat top surface that extends above the top side of the base plate. When coupled to the accessory mount, a portion of the aiming device can contact the top surface of the leveling screw to level the aiming device.

19 Claims, 6 Drawing Sheets

SYSTEM, METHOD, AND APPARATUS FOR LEVELING A FIREARM ACCESSORY

TECHNICAL FIELD

The present disclosure relates generally to firearm accessory mounting. More specifically, the present disclosure relates to a system, method, and apparatus for leveling a firearm accessory on a firearm accessory mount.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

A firearm, for example a rifle, can include an elongated rail for securely mounting a firearm capability enhancement accessory, such as an aiming device (e.g., a reflex collimator sight, holographic sight, magnified scope, or other such aiming devices). These conventional rails can have a generally T-shaped cross-section with a top of the T-shape corresponding to a top of the rail. In addition, these conventional rails can be slotted transversely along a length of the rail, allowing for an indexed spacing of the accessory that is attached to the rail. Some examples of conventional rails include MIL-STD-1913 Picatinny, NATO Accessory Rail (STANAG 4694), or a Weaver Rail.

An accessory mount can be used to attach the aiming device to the rail. Many conventional aiming devices can include external adjustment features (e.g., rotary knobs) that allow a user to adjust the aiming reticle for the aiming device in one or both of the vertical and horizontal directions. These vertical and horizontal adjustments can improve a user's ability to aim the firearm based on distance to the target, wind speed, wind direction, and other factors. However, if the aiming device is not properly aligned on the accessory mount and subsequently on the rail of the firearm, then the vertical and horizontal adjustments provided on the aiming device would nor properly adjust the aiming reticle in the precise vertical or horizontal direction but instead would be adjusting it at an angle to the vertical or horizontal direction in an amount equal to the misalignment of the aiming device to the accessory mount.

Conventional techniques exist for attempting to properly align the aiming device on the accessory mount. One conventional technique is the use of a leveling plumb. However, using a leveling plumb to align the aiming device is cumbersome. Another conventional technique involves the use of a spirit level. However, most users are not able to accurately align the aiming device on the accessory mount using a spirit level. Yet another conventional aligning technique employ the use of wedge-shaped members that are tedious to use.

BRIEF DESCRIPTION OF THE SEVERAL VIEWS OF THE DRAWINGS

For a more complete understanding of the present disclosure and certain features thereof, reference is now made to the following description, in conjunction with the accompanying figures briefly described as follows.

DETAILED DESCRIPTION OF THE EXAMPLE EMBODIMENTS

Example embodiments of the disclosure now will be described more fully hereinafter with reference to the accompanying drawings, in which example embodiments are shown. The concepts discussed herein may, however, be embodied in many different forms and should not be construed as limited to the example embodiments set forth herein; rather, these embodiments are provided so that this disclosure will be thorough and complete, and will fully convey the scope to those of ordinary skill in the art. Like numbers refer to like, but not necessarily the same or identical, elements throughout.

Certain dimensions and features of the novel leveling system for a firearm accessory mount are described herein using the term "approximately." As used herein, the term "approximately" indicates that each of the described dimensions is not a strict boundary or parameter and does not exclude functionally similar variations therefrom. Unless context or the description indicates otherwise, the use of the term "approximately" in connection with a numerical parameter indicates that the numerical parameter includes variations that, using mathematical and industrial principles accepted in the art (e.g., rounding, measurement or other systematic errors, manufacturing tolerances, etc.), would not vary the least significant digit.

In addition, certain relationships between dimensions of the leveling system for a firearm accessory mount described herein and between features of the leveling system for a firearm accessory mount are described herein using the term "substantially." As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions or positions indicates that the equal relationship between the dimensions or positions includes variations that, using mathematical and industrial principles accepted in the art (e.g., rounding, measurement or other systematic errors, manufacturing tolerances, etc.), would not vary the least significant digit of the dimensions. As used herein, the term "substantially constant" indicates that the constant relationship is not a strict relationship and does not exclude functionally similar variations therefrom. As used herein, the term "substantially parallel" indicates that the parallel relationship is not a strict relationship and does not exclude functionally similar variations therefrom. As used herein, the term "substantially orthogonal" or "substantially perpendicular" is not a strict relationship and does not exclude functionally similar variations therefrom.

Figure 1A:
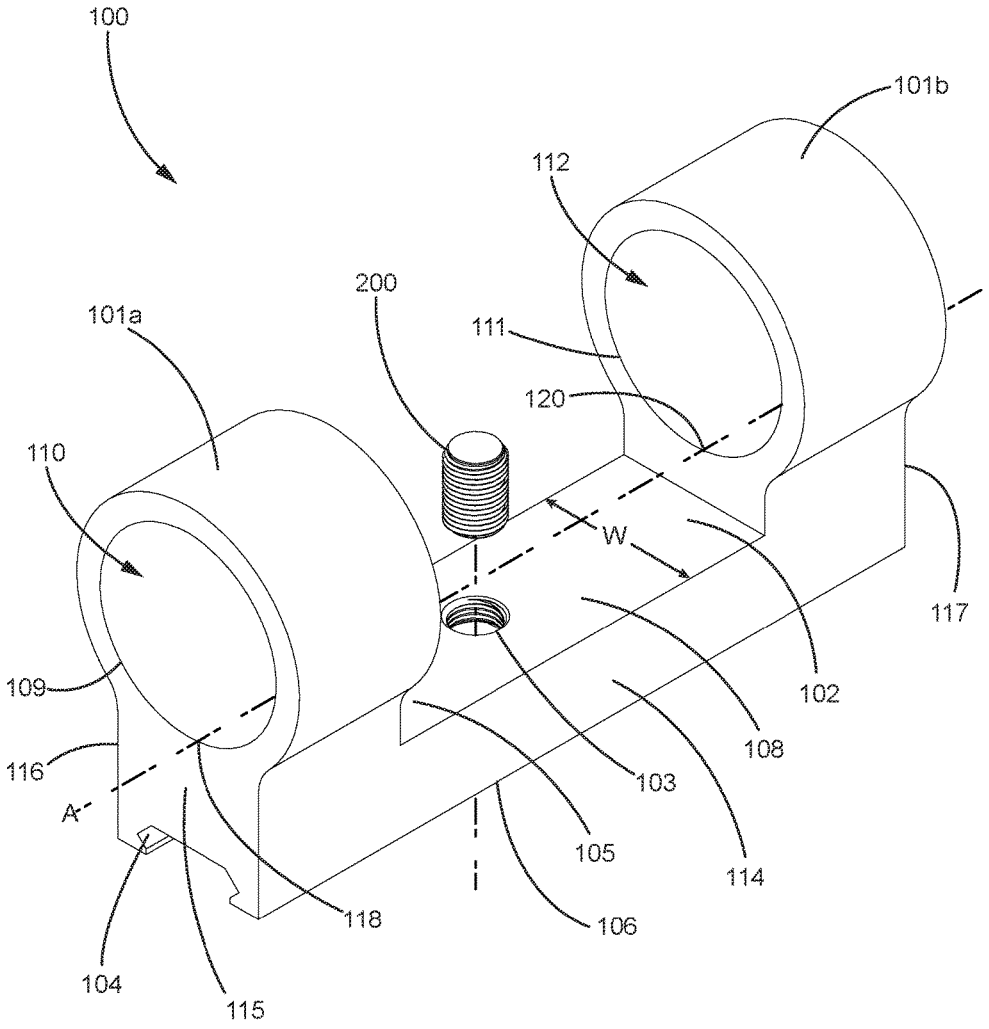
FIG. 1A is a left-side perspective view of a firearm accessory mounting system for coupling a firearm accessory to a firearm, in accordance with one example embodiment of the disclosure.
Figure 1B:
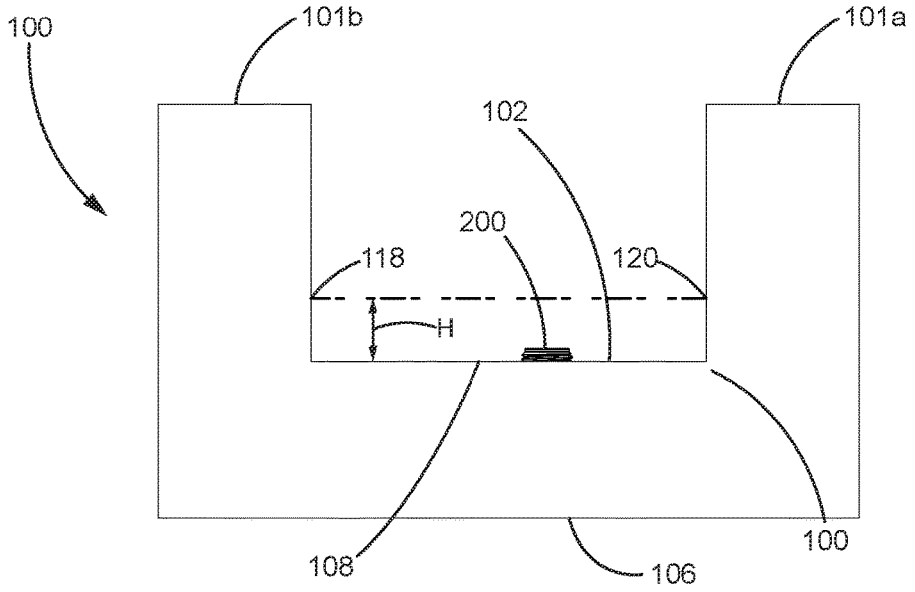
FIG. 1B is a side elevation view of the firearm accessory mounting system of FIG. 1A, in accordance with one example embodiment of the disclosure.
Figure 1C:
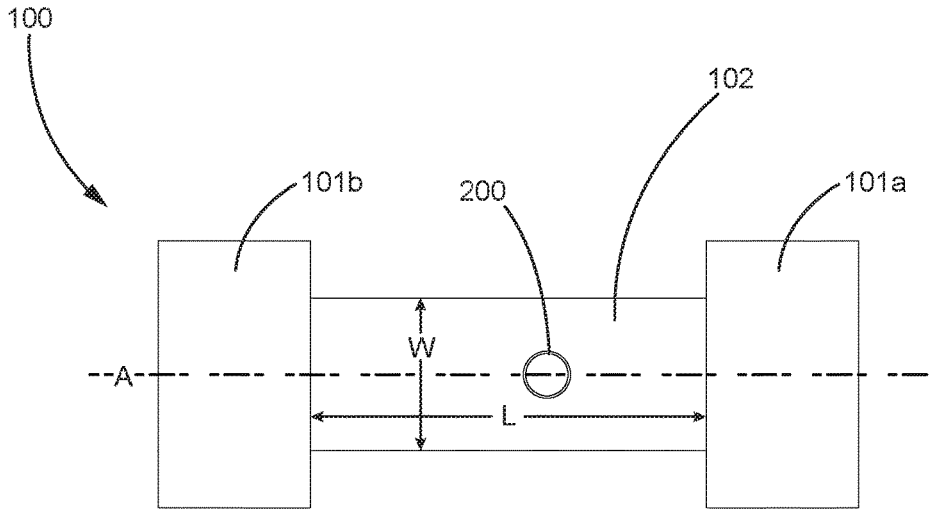
FIG. 1C is a top plan view of the firearm accessory mounting system of FIG. 1A, in accordance with one example embodiment of the disclosure.

FIGS. 1A-1C are various views of an example firearm accessory mounting system or accessory mount 100 for coupling a firearm accessory to a firearm, in accordance with one example embodiment of the disclosure. The exact form of the accessory mount 100 of FIGS. 1A-1C is for example purposes only as the accessory mount for a firearm can have many different shapes, forms, or additional features not presented in the example accessory mount 100. Referring now to FIGS. 1A-D, the example accessory mount 100 can include a base plate 102. In one example, the base plate 102 is a single plate. In other example embodiments, the base plate 102 can be two or more vertically spaced-apart plates with attachment members that couple the vertically spaced-apart base plates to one another. The base plate 102 can include a top surface 105 and an opposing bottom surface 106; a front edge 115, and an opposing back edge 117; and a first lateral side 114 and an opposing second lateral side 116. Each of the first lateral side 114 and second lateral side 116 can generally extend from the front edge 115 to the back edge 117. The bottom surface 106 is configured to abut a rail of a firearm.

The accessory mount 102 can also include one or more scope mounting rings 101. In one example embodiment, the accessory mount 102 includes a first scope mounting ring 101*a* and a second scope mounting ring 101*b*. In certain example embodiments, each scope mounting ring 101*a*, 101*b* is integrally formed with the base plate 102. In other example embodiments, each scope mounting ring 101*a*, 101*b* is separately formed and coupled to the base plate 102.

The first scope mounting ring 101*a* can include an inner wall 109. In certain example embodiments, the inner wall 109 can have an annular or circular shape and can define a cavity 110 that extends through the first scope mounting ring 101*a* along the longitudinal axis A. A bottom edge 118 of the inner wall 109 can be positioned vertically above and spaced apart from the top surface 105 of the base plate 102 a distance H.

The second scope mounting ring 101*b* can include an inner wall 111. In certain example embodiments, the inner wall 111 can have an annular or circular shape and can define a cavity 112 that extends through the second scope mounting ring 101*b* along the longitudinal axis A. A bottom edge 120 of the inner wall 111 can be positioned vertically above and spaced apart from the top surface 105 of the base plate 102 a distance H. In one example, the distance H can be anywhere in the range of substantially 0.001 inches to substantially 0.5 inches.

In certain example embodiments, the first scope mounting ring 101*a* can be positioned generally adjacent the front edge 115 of the base plate 102. Further, the first scope mounting ring 101*a* can be positioned closer to the front edge 115 than the back edge 117 and/or can be positioned closer to the front edge 115 than the second scope mounting ring 101*b*. The first scope mounting ring 101*a* can be configured to receive within the cavity 110 a portion of an aiming device (e.g., a reflex collimator sight, holographic sight, magnified scope, or other such aiming devices) to removably couple the aiming device to the accessory mount 100. While the example embodiment of FIGS. 1A-1C present the first scope mounting ring 101*a* as being a one piece ring, this is for example purposes only. In other example embodiments, the first scope mounting ring 101*a* can be made of two or more pieces and can include coupling devices (e.g., screws, pins, etc.) to couple the two or more pieces together to more easily couple the aiming device to the accessory mount 100. Further, the first scope mounting ring 101*a* can also include other features to make coupling and decoupling the aiming device to the accessory mount 100 easier, such as a clamshell design where two pieces of the first scope mounting ring 101*a* rotate with respect to one another to open and close the ring 101*a* and/or alignment tabs for properly aligning the two or more pieces of the first scope mounting ring 101*a*.

In certain example embodiments, the second scope mounting ring 101*b* can be positioned generally adjacent the back edge 117 of the base plate 102. Further, the second scope mounting ring 101*b* can be positioned closer to the back edge 117 than the front edge 115 and/or can be positioned closer to the back edge 117 than the first scope mounting ring 101*a*. The second scope mounting ring 101*b* can be configured to receive within the cavity 112 a second portion of an aiming device (e.g., a reflex collimator sight, holographic sight, magnified scope, or other such aiming devices) to removably couple the aiming device to the accessory mount 100. While the example embodiment of FIGS. 1A-1C present the second scope mounting ring 101*b* as being a one piece ring, this is for example purposes only. In other example embodiments, the second scope mounting ring 101*b* can be made of two or more pieces and can include coupling devices (e.g., screws, pins, etc.) to couple the two or more pieces together to more easily couple the aiming device to the accessory mount 100. Further, the second scope mounting ring 101*b* can also include other features to make coupling and decoupling the aiming device to the accessory mount 100 easier, such as a clamshell design where two pieces of the second scope mounting ring 101*a* rotate with respect to one another to open and close the ring 101*b* and/or alignment tabs for properly aligning the two or more pieces of the second scope mounting ring 101*b*.

Each scope mounting ring 101*a*, 101*b* can be coupled to extend vertically upward from the top surface 105 of the accessory mount 102. The cavity 110 of the first scope mounting ring 101*a* is aligned with the cavity 112 of the second scope mounting ring 101*b* along the longitudinal axis A. The first scope mounting ring 101*a* can be separated from the second scope mounting ring 101*b* by a distance L along the longitudinal axis A of the base plate 102. The base plate 102 can also include a bridge 108 extending between the first scope mounting ring 101*a* and the second scope mounting ring 101*b*. In certain example embodiments, the bridge 108 can be a planar or substantially planar surface 108 disposed along the top surface 105 of the base plate 102. In one example, the bridge can be positioned between and can extend from substantially the first scope mounting ring 101*a* to substantially the second scope mounting ring 101*b* along the longitudinal axis A. The bridge 108 can have a width W and a length that is less than or equal to the length L. In certain example embodiments, the top surface of the bridge (e.g., the planar or substantially planar surface) 108 is vertically positioned below the bottom edge 118 of the first scope mounting ring 101*a* and the bottom edge 120 of the second scope mounting ring a distance H. In one example, the distance H can be anywhere in the range of substantially 0.001 inches to substantially 0.5 inches.

Figure 4A:
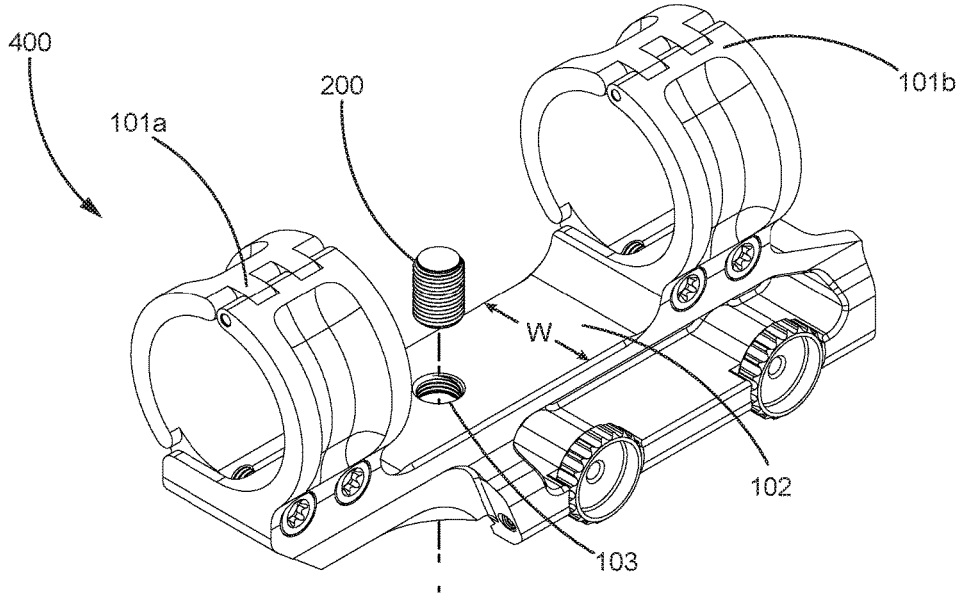
FIGS. 4A-4B are perspective views of another firearm accessory mounting system for coupling a firearm accessory to a firearm, in accordance with another example embodiment of the disclosure.
Figure 4B:
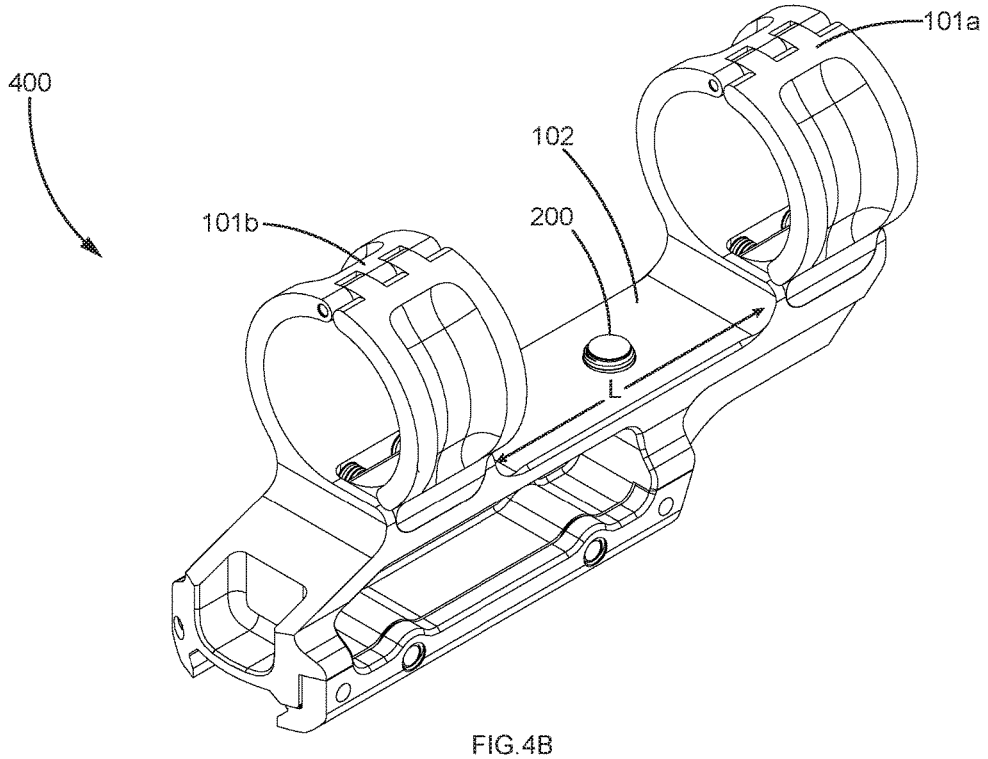

The accessory mount 100 can also include a rail channel or slot 104 for removably coupling the base plate 102 to a rail of a firearm. In example embodiments where there is only a single base plate 102 for the accessory mount 100 the rail channel 104 can be disposed along the bottom surface 106 of the base plate 102. In example embodiments where the base plate 102 includes two or more vertically spaced-apart plates extending substantially parallel to one another with attachment members that couple the vertically spaced-apart base plates to one another, the rail channel 104 can be disposed along the bottom surface 106 of the lower base plate, as shown in accessory mount 400 of FIGS. 4A-4B. The rail channel or slot 104 can extend along the bottom surface 106 of the base plate along the longitudinal axis A. In certain example embodiments, the accessory mount 100 can also include one or more clamping screws (see FIGS. 4A-4B) threadably coupled to the base plate 102 and extending through a portion of the outer edges of the rail channel or slot 104 to facilitate tightening the rail channel or slot 104 to the rail of the firearm. In one example, two clamping screws are provided to tighten the rail channel or slot 104 to the rail of the firearm.

The accessory mount 100 can also include one or more apertures 103 extending through at least a portion of the base plate 102. In example embodiments where the base plate 102 comprises a single plate, as shown in FIG. 1A, the one or more apertures 103 can extend from the top surface 105 of the base plate 102 to the bottom surface 106 of the base plate 102 to provide a passageway through the base plate 102. In example embodiments where the base plate includes two or more vertically spaced-apart plates with attachment members that couple the vertically spaced-apart base plates to one another, each of the one or more apertures 103 may only extend through the plate along which the first scope mounting ring 101*a* and the second scope mounting ring 101*b* are disposed (see the accessory mount 400 of FIGS. 4A-4B). While the example embodiment of FIGS. 1A-1C present one aperture, two or more apertures 103 may be provided.

Each example aperture 103 can extend through the base plate 102 in a direction orthogonal or substantially orthogonal to the longitudinal axis A. Further, each example aperture 103 can be positioned anywhere along the bridge 108 between the first scope mounting ring 101*a* and the second scope mounting ring 101*b* within the width W and length L of the bridge. In other example embodiments, the one or more apertures 103 may not extend all the way through the base plate 102 but may instead extend from the bridge 108 vertically down into a portion of the base plate 102 in a direction orthogonal or substantially orthogonal to the longitudinal axis A. In certain example embodiments, each of the one or more apertures 103 are threaded and configured to be threadably coupled to a leveling screw 200.

Figure 2A:
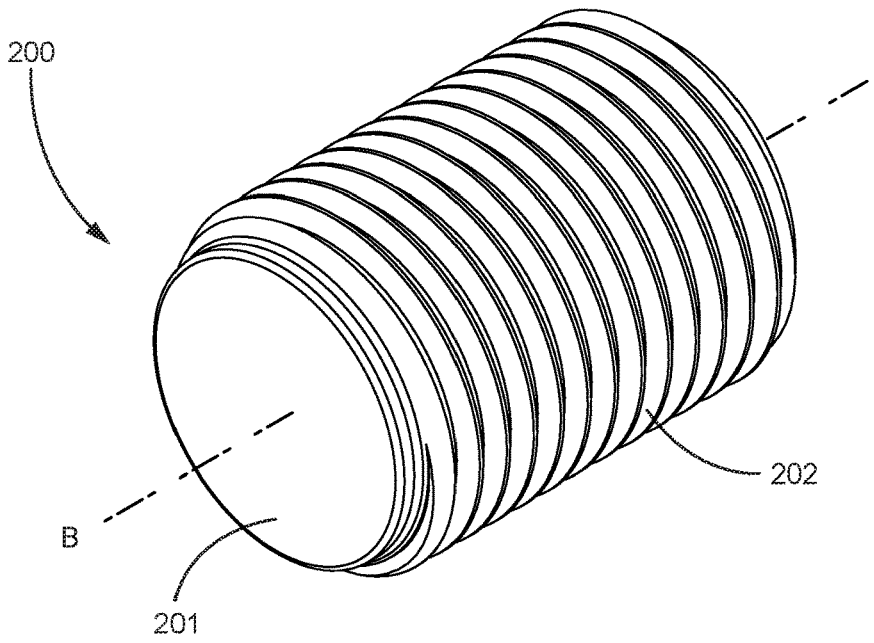
FIG. 2A is a bottom perspective view of a leveling screw for use with the firearm accessory mounting system of FIG. 1A, in accordance with one example embodiment of the disclosure.
Figure 2B:
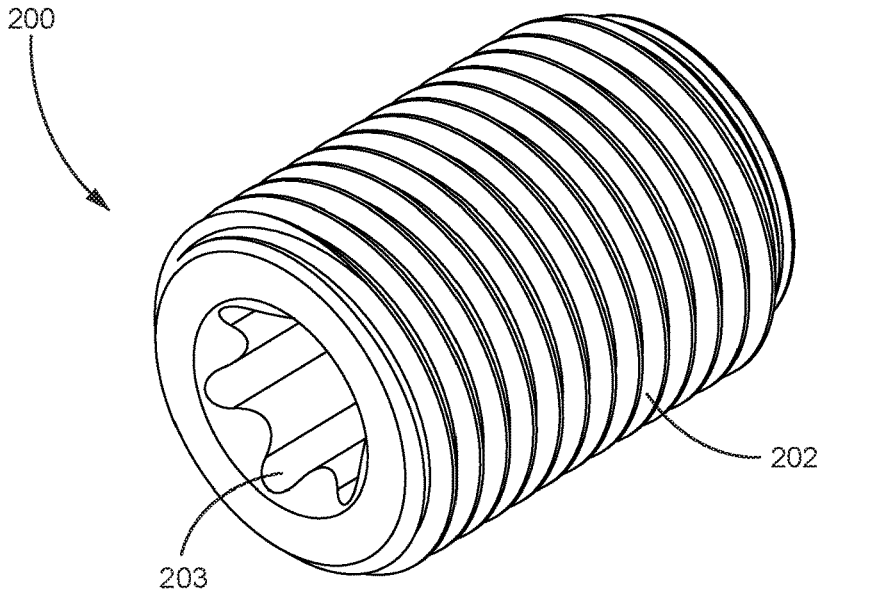
FIG. 2B is a top perspective view of the leveling screw of FIG. 2A for use with the firearm accessory mounting system of FIG. 1A, in accordance with one example embodiment of the disclosure.

The accessory mount 100 can also include one or more leveling screws 200. Each leveling screw 200 can threadably coupled to and decoupled from a corresponding one of the one or more apertures 103. FIGS. 2A-2B provide top and bottom perspective views of a leveling screw 200, in accordance with one example embodiment of the disclosure. Referring to FIGS. 1A-2B, each leveling screw 200 can include a first end that includes a scope leveling contact surface 201, a distal second end that includes a socket 203, and threads 202 disposed along all or at least a portion of the outer side wall of the leveling screw 200 between the socket 203 and the scope leveling contact surface 201. The threads 202 can be fine threads or coarse threads.

In one example embodiment, the scope leveling contact surface 201 can be a flat or substantially planar surface orthogonal or substantially orthogonal to the longitudinal axis B of the leveling screw 200. In other example embodiments, the scope leveling contact surface 201 can be a concave or cup surface extending into the body of the leveling screw 200, a domed or convex surface extending out from the first end of the leveling screw 200, or a frustoconical surface. The socket 203 can be any type of socket for driving screws known to those of ordinary skill in the art, including, but not limited to a hex-shaped socket, a square-shaped socket, a Phillips-head socket, and a straight-slotted socket. A user can insert a screwdriver or other drive element into the socket 203 to rotate the leveling screw 200 to threadably couple or decouple the leveling screw 200 into the aperture 103 of the accessory mount.

Figure 3A:
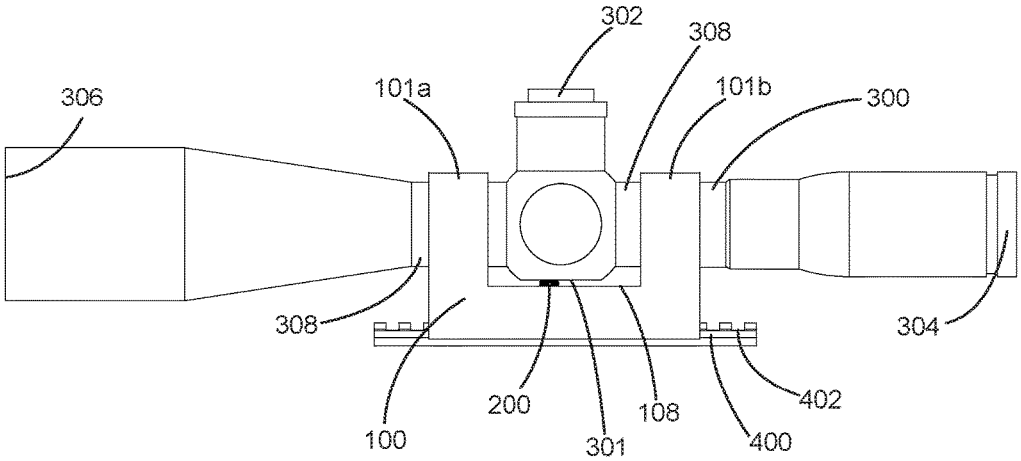
FIG. 3A is a side elevation view of the firearm accessory mounting system of FIG. 1A with firearm accessory coupled to a rail of a firearm, in accordance with one example embodiment of the disclosure.
Figure 3B:
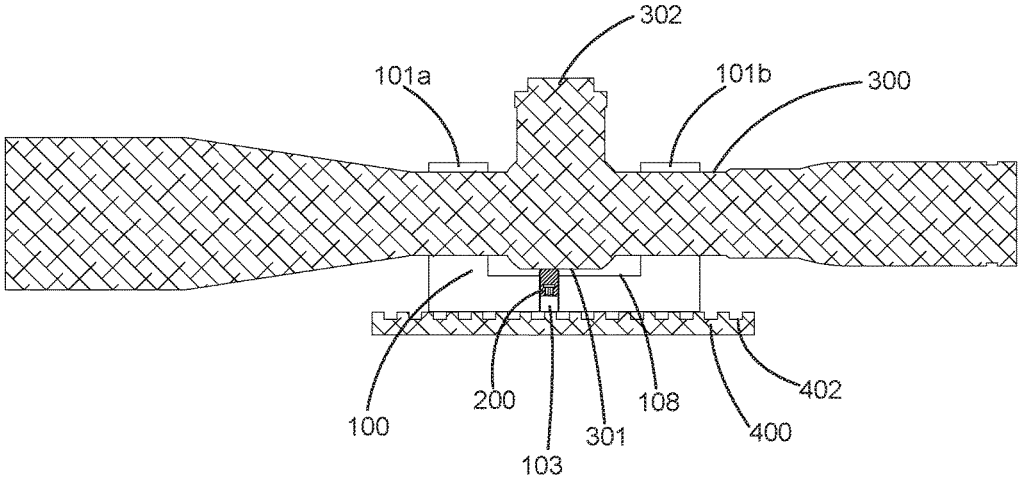
FIG. 3B is a cross-sectional view of the firearm accessory mounting system of FIG. 1A with firearm accessory coupled to a rail of a firearm, in accordance with one example embodiment of the disclosure.
Figure 3C:
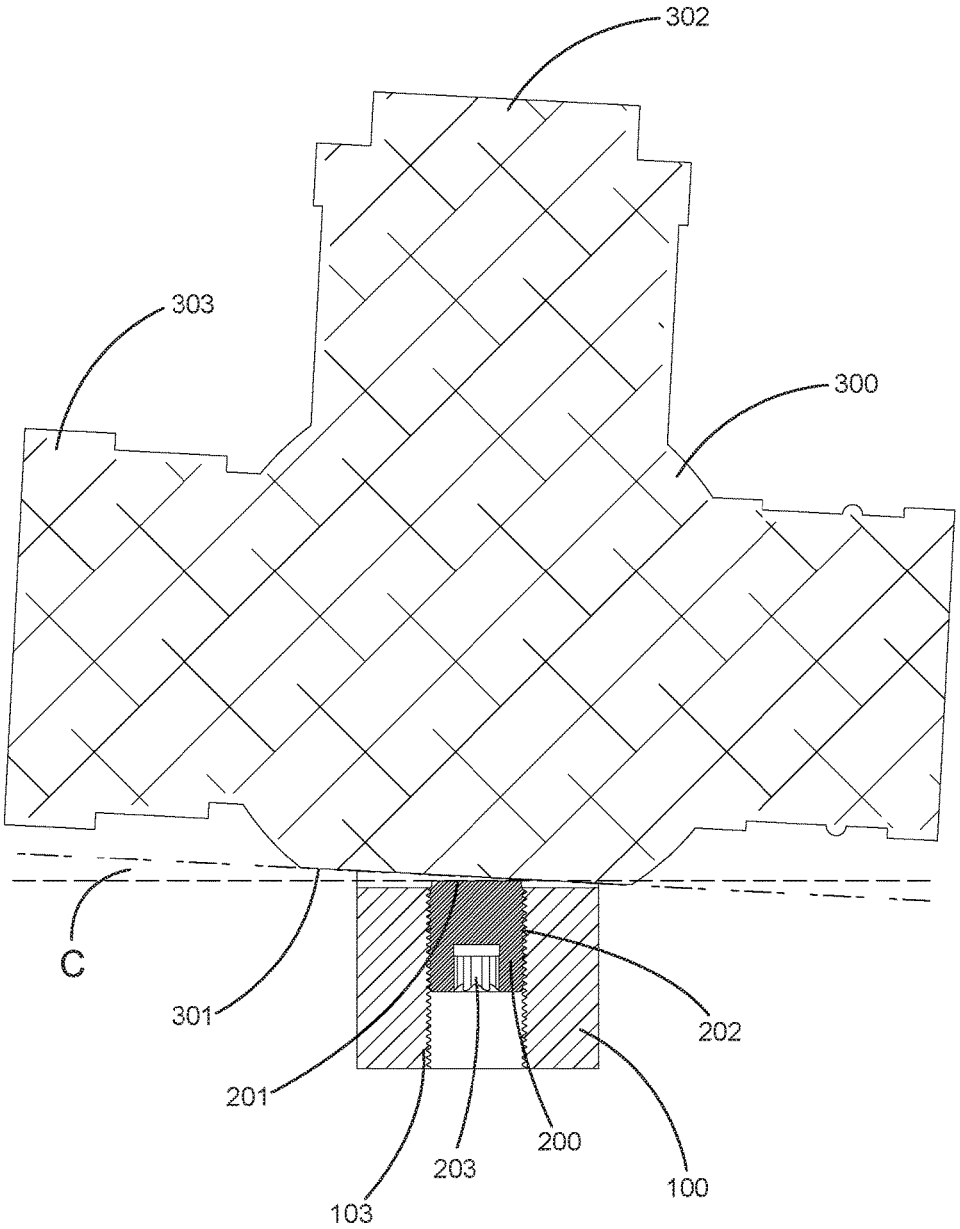
FIG. 3C is a partial cross-sectional view of the firearm accessory mounting system of FIG. 1A with a firearm accessory, in accordance with one example embodiment of the disclosure.

FIGS. 3A-3C are various views of the firearm accessory mounting system of FIG. 1A coupled to a firearm accessory and coupled to a rail of a firearm, in accordance with one example embodiment of the disclosure. Now referring to FIGS. 1A-3C, as discussed above, the firearm accessory 300 can be removably coupled to the accessory mount 100. One example of the firearm accessory 300 is an aiming device, such as the rifle scope 300 shown in FIGS. 3A-3C. The rifle scope 300 can include a first end and a distal second end. The first end can include an ocular lens 304 and the second end can include an objective lens 306. The rifle scope 300 can also include one or more scope tubes 308 extending between the ocular lens 304 to the objective lens 306. In one example, the scope tubes 308 have an outer diameter that is less than or equal to the inner diameter of the inner walls 109, 111 of the first scope mounting ring 101*a* and the second scope mounting ring 101*b* to extend through the respective cavities 110, 112 and to be held in place by the respective first scope mounting ring 101*a* and second scope mounting ring 101*b*.

The rifle scope 300 can also include a reticle housing disposed between the ocular lens 304 and the objective lens 306. The reticle housing can include magnified optic base 301 disposed along a bottom side of the reticle housing and the rifle scope 300. The magnified optic base 301 can be made of metal or any other material and can have a flat or substantially flat portion or otherwise have a flat or substantially flat bottom surface. The magnified optic base 301 can abut the leveling screw 200 when leveling the rifle scope 300 to the accessory mount 100.

The rifle scope 300 can also include a vertical reticle adjustment knob 302 movably coupled to the reticle housing. The vertical reticle adjustment knob 302 can be positioned along a top side of the reticle housing opposite the magnified optic base 301, in certain example embodiments. The vertical reticle adjustment knob 302 can be manually rotatable or otherwise adjustable by a user to adjust the vertical position of the reticle within the rifle scope 300. The rifle scope 300 can also include a horizontal reticle adjustment knob 302 movably coupled to the reticle housing. The horizontal reticle adjustment knob 303 can be position along a lateral side of the reticle housing. The horizontal reticle adjustment knob 303 can be manually rotatable or otherwise adjustable by a user to adjust the horizontal (left to right and orthogonal to the longitudinal axis A) position of the reticle within the rifle scope 300.

As shown in FIGS. 3A and 3B, a user can threadably couple the leveling screw 200 to the leveling aperture 103 and a portion of the leveling screw 200 that includes the scope leveling contact surface 201 can extend up above the top surface of the bridge 108 and/or the top surface 105 of the base plate 102 adjacent the aperture 103. By rotating the leveling screw 200 clockwise or counter-clockwise, the height that the scope leveling contact surface 201 is positioned above the top surface of the bridge 108 and/or the top surface 105 of the base plate 102 can be modified to increase or decrease the height. This adjustment of the leveling screw 200 can be made by a user prior to coupling the accessory mount 100 to the rail 400 of the firearm and optionally prior to coupling the rifle scope 300 or other aiming device to the accessory mount 100. If not already completed, a user can then couple the rifle scope 300 or other aiming device to the accessory mount 100. For example, the user can adjust each of the first scope mounting ring 101*a* and second scope mounting ring 101*b* to open (e.g., through the use of a clamshell or other mechanism as described above) to allow the rifle scope 300 or other aiming device to be placed within the cavity 110, 112, of each respective first scope mounting ring 101*a* and second scope mounting ring 101*b*. The user can then adjust each of the first scope mounting ring 101*a* and second scope mounting ring 101*b* to close about respective portions of the rifle scope 300 (e.g., the scope tubes 308) or other aiming device to couple it to the accessory mount 100.

While coupled to the accessory mount 100, the rifle scope 300 or other aiming device may still be able to rotate about an axis parallel to the axis A within the first scope mounting ring 101*a* and the second scope mounting ring 101*b*. This rotational capability of the rifle scope 300 can allow the user to rotate the rifle scope 300 or other aiming device until the bottom surface of the magnified optic base 301 contacts the scope leveling contact surface 201 of the leveling screw. When maximum contact between the magnified optic base 301 and the scope leveling contact surface 201 is achieved, the rifle scope 300 or other aiming device will be level with respect to the accessory mount in both the horizontal, vertical, and rotational directions.

The user may then further tighten the first scope mounting ring 101*a* and second scope mounting ring 101*b* about the rifle scope 300 or other aiming device to prevent further rotation or sliding movement of the rifle scope 300 or other aiming device with respect to the accessory mount 100. The user may then optionally remove the leveling screw 200 from the accessory mount 100 through counter-clockwise rotation of the leveling screw. In other example embodiments, the leveling screw 200 can remain in place coupled to the accessory mount and abutting the magnified optic base 301.

The user may then couple the accessory mount 100 to the rail 400 of the firearm. For example, the user may slide the rail channel 104 onto the rail 400 and couple the rail channel 104 to the rail 400 of the firearm using one or more clamping screws or any other form of coupling device. In one example embodiment, the rail 400 is a Picatinny rail that can include multiple grooves 402 extending across the rail 400 in a direction orthogonal or substantially orthogonal to the longitudinal axis A of the accessory mount 100. In other example embodiments, any other type of rail, including, but not limited to, a NATO Accessory Rail (STANAG 4694) or a Weaver Rail may be used. In other examples other techniques for attaching the accessory mount 100 to the firearm may be used. The firearm can be a rifle, pistol or any other type of firearm known to those of ordinary skill in the art.

Although the firearm accessory mount features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents.

Conditional language, such as, among others, "can," "could," "might," or "may," unless specifically stated otherwise, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

What is claimed is:

1. A firearm accessory mount comprising:

a base plate comprising:

a top side;

an opposing bottom side; and an aperture extending from the top side to the bottom side;

a first scope mounting ring coupled to the base plate and extending up from the top side of the base plate;

a second scope mounting ring coupled to the base plate and extending up from the top side of the base plate;

wherein the aperture is disposed through the base plate between the first scope mounting ring and the second scope mounting ring; and a rotating leveling screw threadably coupled to the aperture and comprising a first end extending above the top side of the base plate and defining a scope leveling contact surface, wherein the scope leveling contact surface of the first end of the rotating leveling screw is configured to contact an aiming device held by the first scope mounting ring and the second scope mounting ring.

2. The firearm accessory mount of claim 1, further comprising a rail mounting channel disposed along the bottom side of the base plate.

3. The firearm accessory mount of claim 2, further comprising at least one coupling device threadably coupled to the rail mounting channel and configured to couple the firearm accessory mount to a firearm.

4. The firearm accessory mount of claim 1, wherein the base plate further comprises a bridge disposed between the first scope mounting ring and the second scope mounting ring.

5. The firearm accessory mount of claim 4, wherein the aperture is positioned on the bridge and extends through the bridge.

6. The firearm accessory mount of claim 4, wherein the rotating leveling screw extends through the base plate.

7. The firearm accessory mount of claim 4, wherein the bridge comprises a top surface and wherein the top surface of the bridge is substantially planar.

8. The firearm accessory mount of claim 7, wherein the first scope mounting ring comprises a first inner wall defining a first channel through the first scope mounting ring at a first vertical position, wherein the second scope mounting ring comprises a second inner wall defining a second channel through the second scope mounting ring at a second vertical position, and wherein the top surface of the bridge is at a third vertical position that is less than the first vertical position and the second vertical position.

9. The firearm accessory mount of claim 1, wherein the leveling screw further comprises:

a second end distal from the first end and comprising a socket; and a plurality of threads disposed between the first end and the second end.

10. The firearm accessory mount of claim 1, wherein the scope leveling contact surface is a substantially planar surface.

11. The firearm accessory mount of claim 1, wherein the scope leveling contact surface is one of a planar surface, a concave surface, a convex surface, or a frustoconical surface.

12. The firearm accessory mount of claim 1, further comprising:

a second base plate disposed below and vertically separated from the base plate, the second base plate comprising:

a second top side;

an opposing second bottom side; and a rail mounting channel disposed along the second bottom side of the base plate and configured to abut a rail of a firearm; and as least one attachment member coupling the base plate to the second base plate.

13. The firearm accessory mount of claim 1, further comprising the aiming device removably coupled to the first scope mounting ring and the second scope mounting ring.

14. The firearm accessory mount of claim 13, wherein the aiming device is a rifle scope.

15. A firearm accessory mount configured to be removably coupled to a firearm, the firearm accessory mount comprising:

a base plate comprising:

a top side;

a bottom side;

a bridge portion comprising a first end and a distal second end;

an aperture extending through the bridge portion from the top side to the bottom side;

a first scope mounting ring coupled to the base plate adjacent the first end of the bridge portion;

a second scope mounting ring coupled to the base plate adjacent the second end of the bridge portion; and a rotating leveling screw threadably coupled to the aperture, the leveling screw comprising:

a first end comprising a socket; and a distal second end extending above the top side of the base plate and comprising a scope leveling contact surface; and wherein the scope leveling contact surface extends above a top surface of the bridge portion and is configured to provide a sole point of contact with a housing of an aiming device held by the first scope mounting ring and the second scope mounting ring to level the aiming device.

16. The firearm accessory mount of claim 15, further comprising a rail mounting channel.

17. The firearm accessory mount of claim 15, wherein the top surface of the bridge is substantially planar, wherein the first scope mounting ring comprises a first inner wall comprising a first bottom edge disposed at a first vertical position, wherein the second scope mounting ring comprises a second bottom edge at a second vertical position, and wherein the top surface of the bridge is at a third vertical position that is less than the first vertical position and the second vertical position.

18. The firearm accessory mount of claim 15, further comprising:

a second base plate disposed below and vertically separated from the base plate, the second base plate comprising:

a second top side;

an opposing second bottom side; and a rail mounting channel disposed along the second bottom side of the base plate and configured to abut a rail of a firearm; and as least one attachment member coupling the base plate to the second base plate.

19. A method of leveling an aiming device on a firearm accessory mounting comprising:

providing a firearm accessory mount comprising:

a base plate comprising:

a top side;

an opposing bottom side; and an aperture extending from the top side to the bottom side;

a first scope mounting ring coupled to the base plate; and a second scope mounting ring coupled to the base plate;

wherein the aperture is disposed through the base plate between the first scope mounting ring and the second scope mounting ring;

providing a rotating leveling screw comprising:

a first end; and a second end comprising a scope leveling contact surface;

providing an aiming device comprising:

a housing comprising a bottom surface threadably coupling the leveling screw into the aperture until the scope leveling contact surface extends a first distance above the top side of the base plate;

coupling a first portion of the aiming device to the first scope mounting ring;

coupling a second portion of the aiming device to the second scope mounting ring, wherein the housing of the aiming device is disposed above the aperture; and rotating the leveling screw until the scope leveling contact surface of the leveling screw makes contact with the bottom surface of the housing.

* * * * *